US010876503B2

(12) United States Patent
Trask

(10) Patent No.: US 10,876,503 B2
(45) Date of Patent: Dec. 29, 2020

(54) VEHICLE AIR INTAKE ASSEMBLY

(71) Applicant: Nick Trask, Phoenix, AZ (US)

(72) Inventor: Nick Trask, Phoenix, AZ (US)

( * ) Notice: Subject to any disclaimer, the term of this patent is extended or adjusted under 35 U.S.C. 154(b) by 0 days.

(21) Appl. No.: 15/625,706

(22) Filed: Jun. 16, 2017

(65) Prior Publication Data

US 2018/0363601 A1 Dec. 20, 2018

(51) Int. Cl.
*F02M 35/10* (2006.01)
*F02M 35/024* (2006.01)

(52) U.S. Cl.
CPC ..... *F02M 35/10078* (2013.01); *F02M 35/02416* (2013.01)

(58) Field of Classification Search
CPC ..... F02M 35/10078; F02M 35/02416
USPC ..... 123/184.21
See application file for complete search history.

(56) References Cited

U.S. PATENT DOCUMENTS 4,688,511 A * 8/1987 Gerlach ..... B01D 46/0086 116/268
4,826,512 A * 5/1989 Fuller ..... B01D 46/0004 55/283
5,937,816 A * 8/1999 Wincewicz ..... F02M 19/00 123/195 A
6,374,815 B1 * 4/2002 Ness ..... F01M 13/022 123/198 E
6,395,048 B1 * 5/2002 Yoder ..... B01D 46/0041 123/198 E
2007/0251392 A1 * 11/2007 Tschech ..... B01D 46/0005 96/147
2010/0043367 A1 * 2/2010 Desjardins ..... B01D 46/0005 55/493
2012/0279911 A1 * 11/2012 Cofini ..... B01D 29/055 210/95
2015/0075121 A1 * 3/2015 Leitner ..... F02M 35/082 55/309

OTHER PUBLICATIONS

RSD Clarity line, Sep. 2015, Roland Sands Design (see products and description per attached PDF) (Year: 2015).*

* cited by examiner

*Primary Examiner* — Hung Q Nguyen
*Assistant Examiner* — Anthony Donald Taylor, Jr.
(74) *Attorney, Agent, or Firm* — Ice Miller LLP

(57) ABSTRACT

A vehicle air intake assembly is disclosed. The assembly includes a base member having an aperture configured to allow air to flow through the base member and into an engine and an outer member spaced from the base member to position an air filter between the outer member and the base member.

18 Claims, 9 Drawing Sheets

VEHICLE AIR INTAKE ASSEMBLY

BACKGROUND

Vehicles, such as motorcycles, may have an internal combustion engine as a powerplant, which draws air to mix with fuel for combustion. The intake air is filtered in order to prevent debris and other objects from entering the engine or a specific engine component, such as a carburetor or intake manifold, and causing damage therein. Conventional engine assemblies may include an air filter contained within an air filter housing, but such air filters may not be visible to allow a user readily to determine the condition of an air filter or other air intake system component, such as during troubleshooting or maintenance. Additionally, conventional air filter housings may include substantial structures and/or parts that are positioned in or along an air intake path, thereby impeding the flow of air and reducing the overall efficiency of the intake system and the engine. Further, conventional air filter housings may include parts in or near the air filter housing that are capable of detaching from the air filter housing or other assembly and being ingested into the engine or engine component to cause damage, blockage, or another undesirable event in the engine or engine component.

Therefore, there exists a need for a vehicle air intake assembly that allows a user to view an air filter or other air intake assembly component located within the air intake assembly. There also exists a need for a vehicle air intake assembly that improves the flow of air to the engine and reduces the likelihood of damage to an engine component caused by ingestion of an object into the engine component.

SUMMARY

In accordance with an embodiment of the present disclosure, a vehicle air intake assembly includes a base member having at least one aperture configured to permit flow of air therethrough, an outer member, and a plurality of arms rotatably coupled to the base member and configured to couple the base member to the outer member.

In accordance with an embodiment of the present disclosure, a vehicle air intake assembly including a base member having an aperture configured to allow air to flow therethrough and into an engine, an outer member spaced from the base member to position an air filter between the outer member and the base member, at least one fastener coupling the base member to the outer member, wherein the at least one fastener is configured to couple the base member to the outer member such that the air filter is disposed between the at least one fastener and the aperture, and an orifice member coupled to the base member by a means of coupling the orifice member to the base member.

In accordance with an embodiment of the present disclosure, a vehicle intake assembly includes a base member having an aperture configured to allow air to flow therethrough, an air filter configured to filter air flowing through the aperture, an end member disposed at an outer end of the air filter and configured to direct airflow through the air filter and at least partially transmit light such that the aperture is visible through the end member, and an orifice member coupled to the base member at the aperture.

BRIEF DESCRIPTION OF THE FIGURES

The embodiments described herein and other features, advantages, and disclosures contained herein, and the manner of attaining them, will be better understood from the following description in conjunction with the accompanying drawing figures, in which like reference numerals identify like elements, and wherein.

DETAILED DESCRIPTION

In the following detailed description of embodiments of the present disclosure, reference is made to the accompanying drawings that form a part hereof, and in which is shown by way of illustration, and not by way of limitation, such specific embodiments. It is to be understood that other embodiments may be utilized and that changes may be made without departing from the spirit and scope of the present disclosure.

Figure 1:
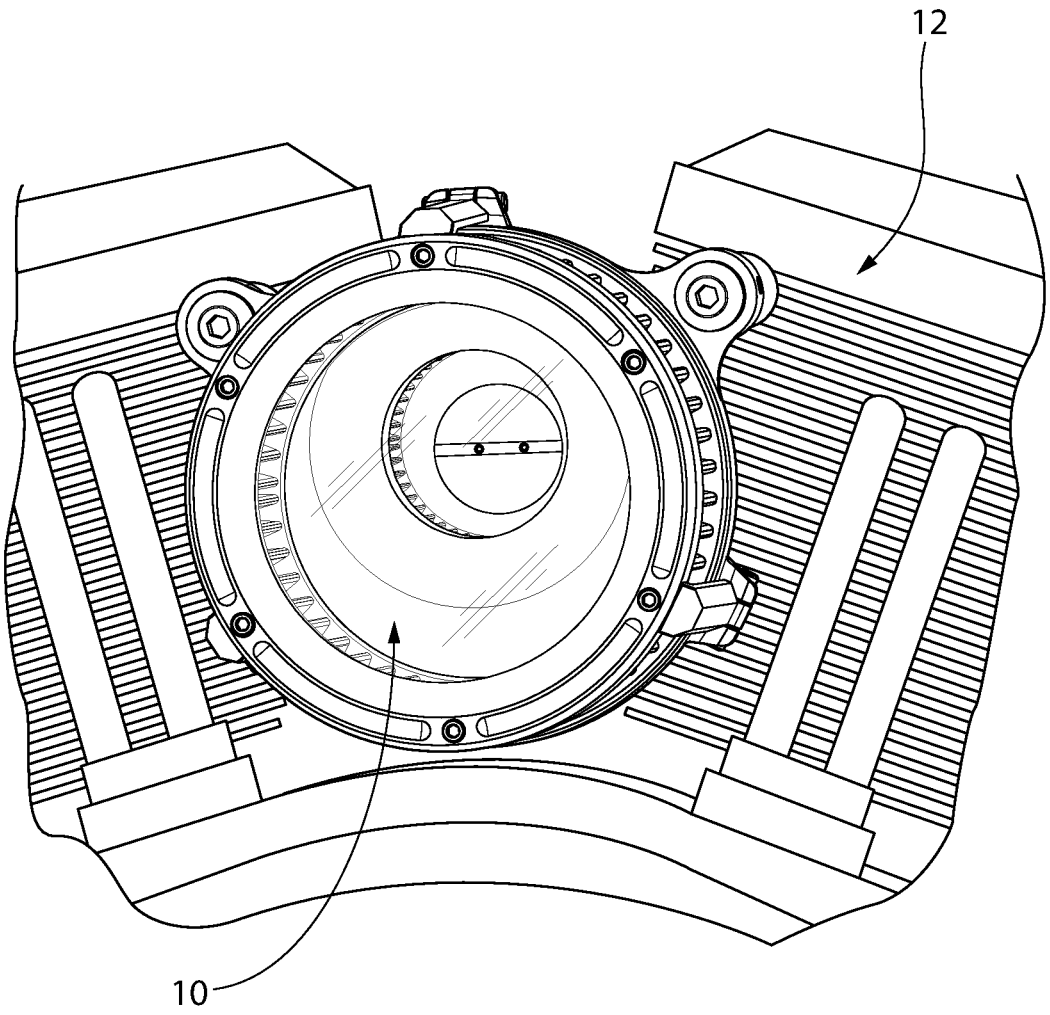
FIG. 1 illustrates a vehicle air intake assembly in accordance with aspects of the present disclosure.

Referring now to FIG. 1, a vehicle air intake assembly 10 is illustrated in accordance with an embodiment of the present disclosure. The assembly 10 is coupled to an engine 12 in the embodiment illustrated in FIG. 1. The engine 12 forms the powerplant of a motorcycle in the illustrated embodiment, but forms the powerplant of another vehicle in one or more additional embodiments.

Figure 2:
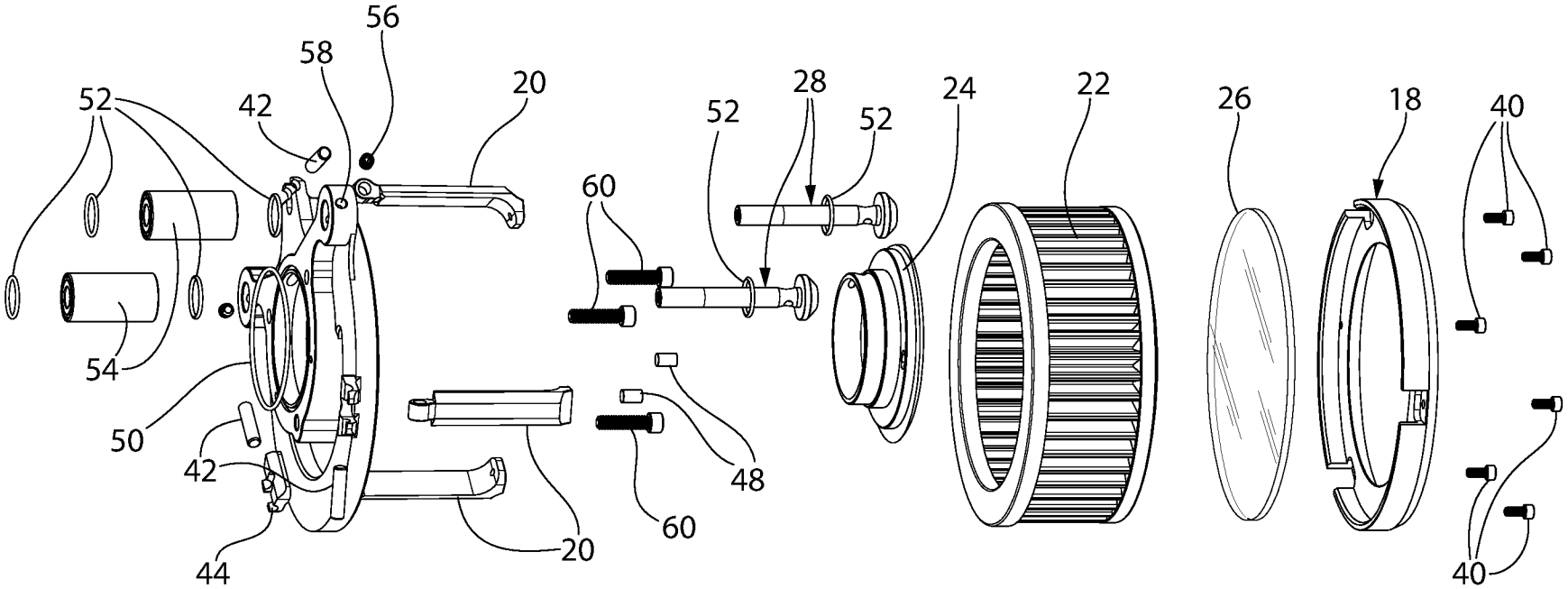
FIG. 2 is an exploded side perspective view of a vehicle air intake assembly in accordance with aspects of the present disclosure.
Figure 3:
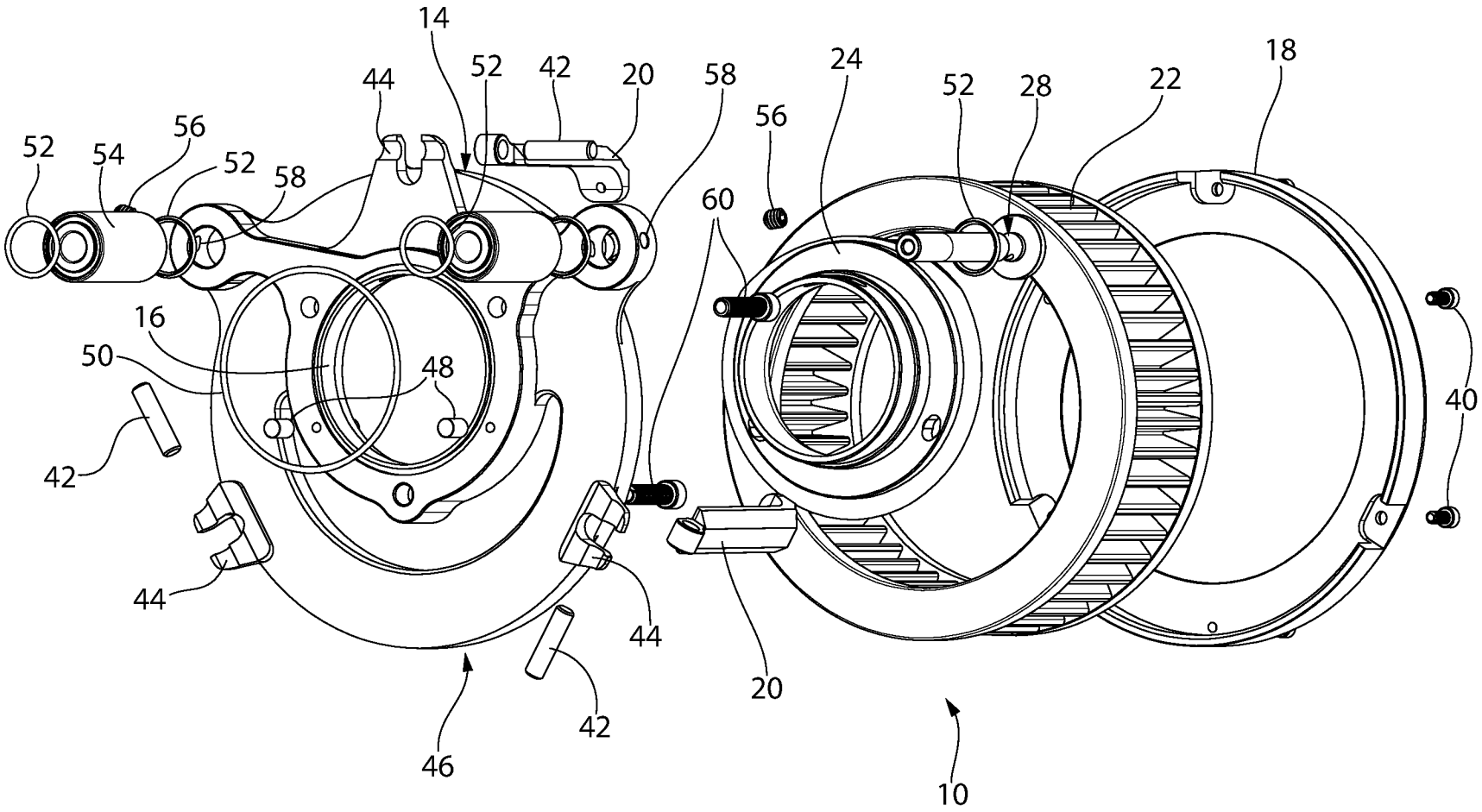
FIG. 3 is an exploded rear side perspective view of a vehicle air intake assembly side perspective view in accordance with aspects of the present disclosure.

FIGS. 2 and 3 are exploded views of the assembly 10 according to an embodiment of the present disclosure. The assembly 10 includes a base member 14 having an aperture 16 configured to permit a flow of air therethrough and into the engine 12. The assembly 10 further includes an outer member 18 and a plurality of arms 20 configured to couple the base member 14 to the outer member 18. In an embodiment, the assembly 10 further includes an air filter 22 disposed between the base member 14 and the outer member 18.

The assembly 10 further includes an end member 26, in an embodiment, configured to direct airflow between the base member 14 and the outer member 18. In an embodiment, the end member 26 is configured to restrict airflow at the outer member 18. The end member 26 in an embodiment is at least partially transparent. In the embodiment illustrated in FIG. 9, the aperture 16 is visible through the end member 26.

One or more of the arms 20 is rotatably coupled to the base member 14 and/or the outer member 18 in one or more embodiments, and nonrotatably coupled to the base member 14 and/or the outer member 18 in one or more embodiments. In the illustrated embodiment, the arms 20 are rotatably coupled to the base member 14 and nonrotatably coupled to the outer member 18. With reference to FIGS. 2 and 3, the assembly 10 of an embodiment includes one or more outer member fastener(s) 40 configured to couple the outer member 18 to one or more of the plurality of arms 20. Additionally, one or more pin(s) 42 rotatably couple one or more of the arm(s) 20 to the base member 14 in the illustrated embodiment with one or more pin channel(s) 44 disposed around a perimeter 46 of the base member 14.

Figure 4:
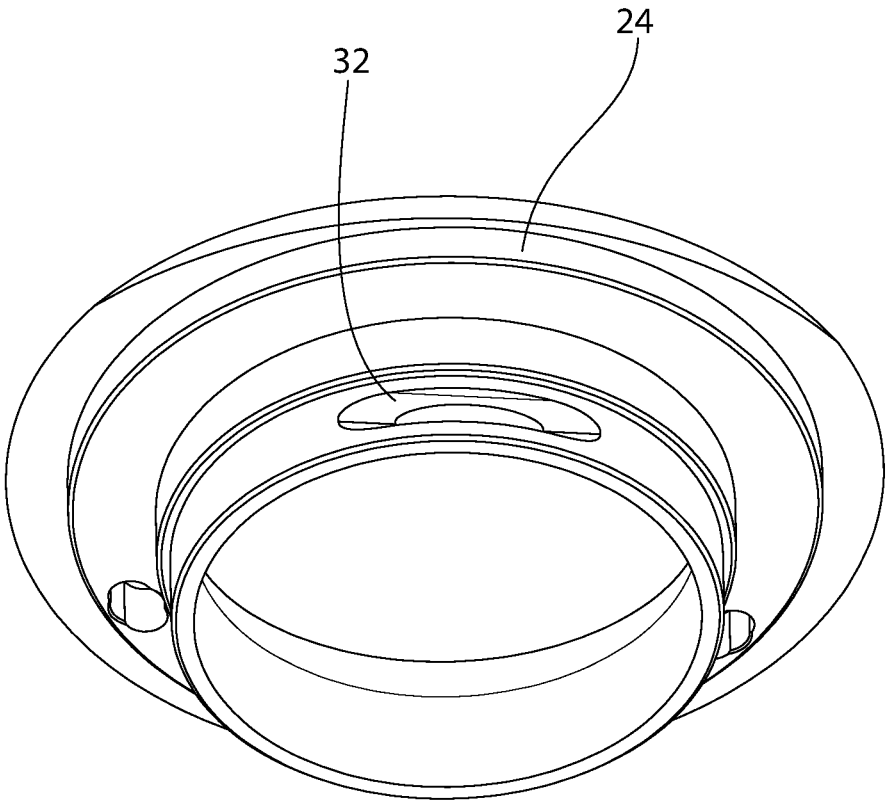
FIG. 4 is a top perspective view of an orifice member of a vehicle air intake assembly in accordance with aspects of the present disclosure.

Referring now to FIG. 4, the assembly 10 of an embodiment further includes an orifice member 24 coupled to the base member 14. The orifice member 24 of one or more embodiments may include a first orifice member, a second orifice member, or another orifice member sized such that the first orifice member has a larger diameter orifice than the second orifice member. The orifice member 24 may include one or more orifices of any size diameter orifice, and such orifice(s) may be coupled to the base member 14 at the aperture 16. In one or more embodiments, the orifice member 24 is not round and assumes another shape. In one or more embodiments of the present disclosure, the assembly 10 and the base member 14 are configured to accept orifice members 24 of varying sizes and geometries such that the orifice member 24 is interchangeable with another orifice member.

Figure 8:
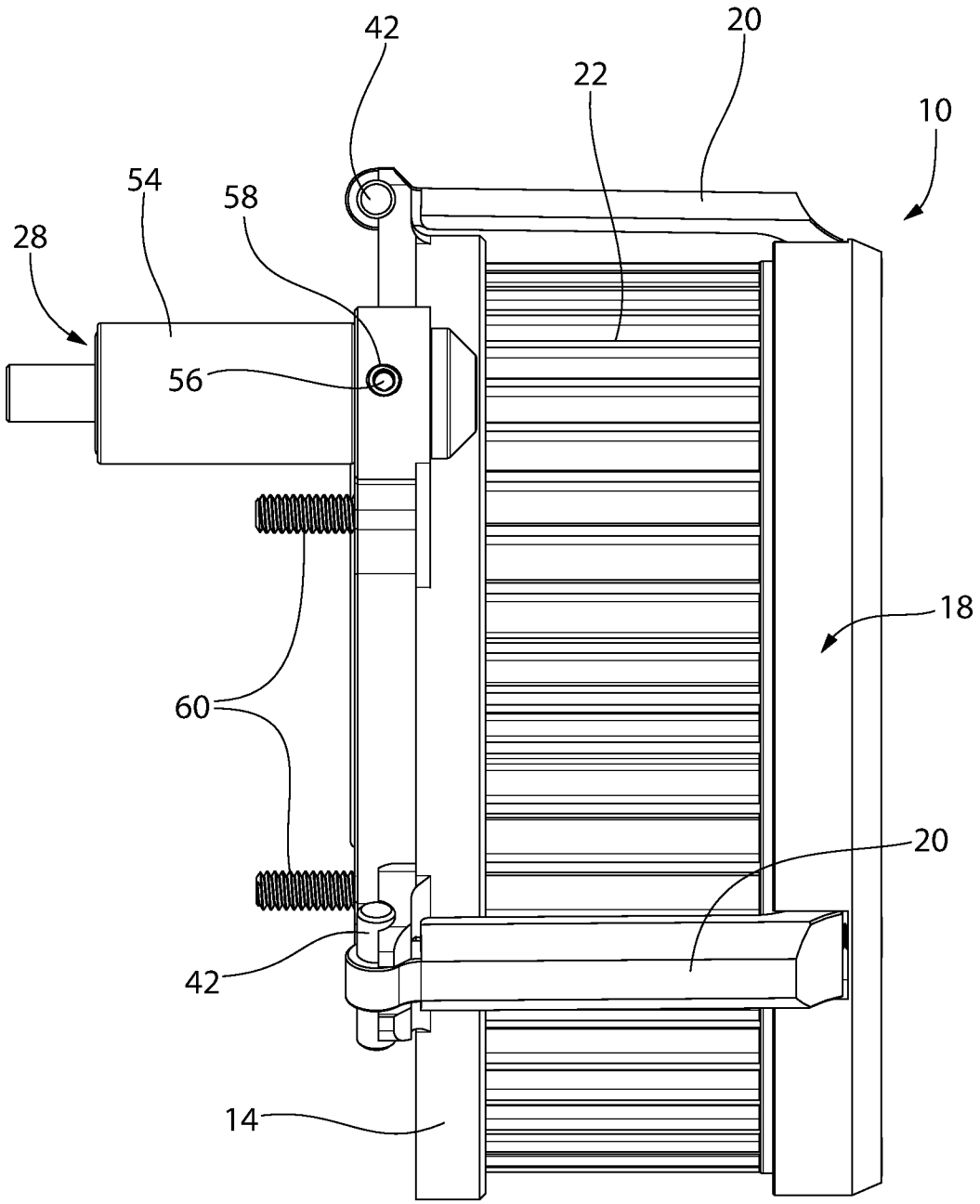
FIG. 8 is a side elevation view of the vehicle air intake assembly in accordance with aspects of the present disclosure.
Figure 9:
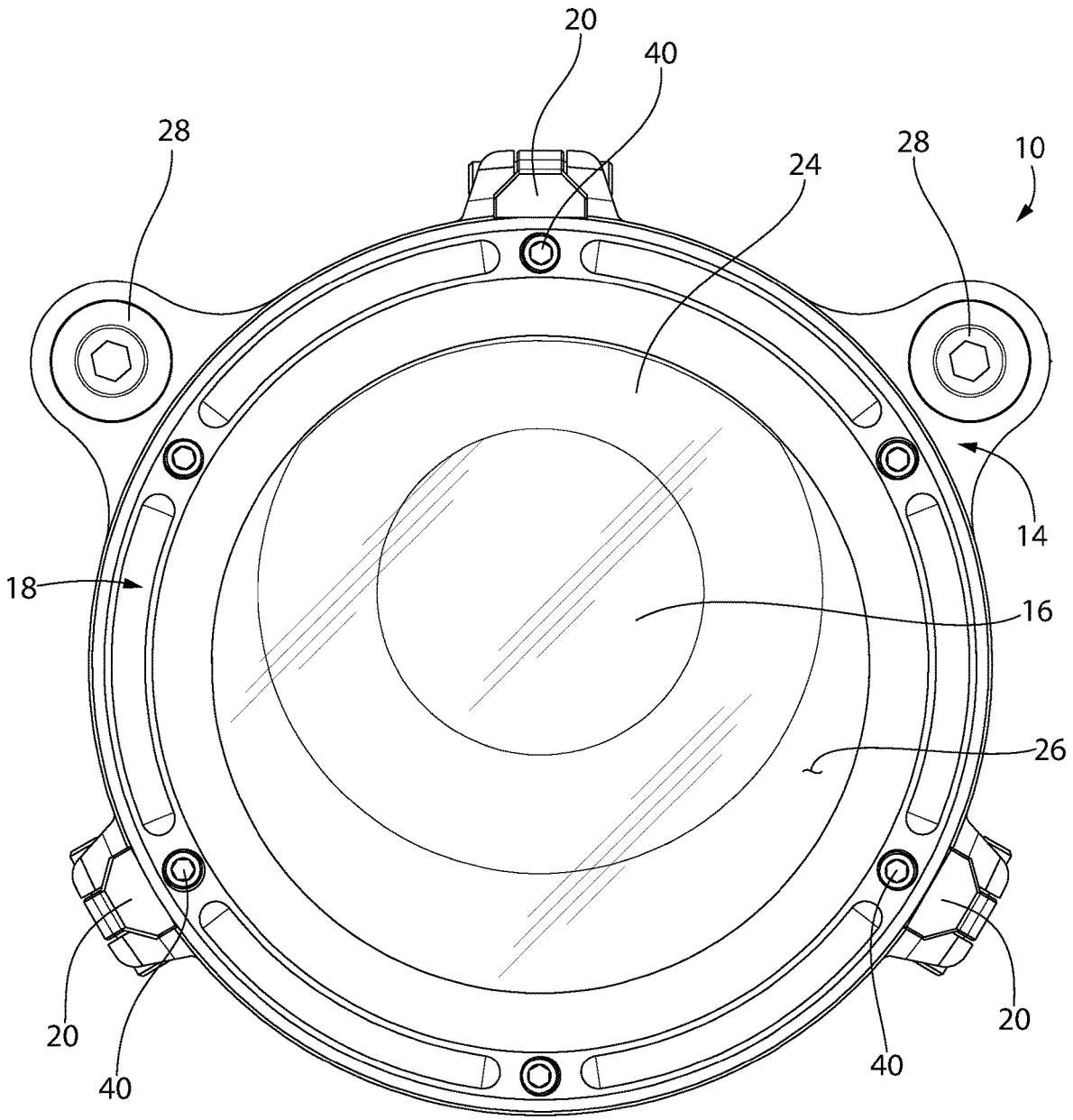
FIG. 9 is a front elevation view of the vehicle air intake assembly in accordance with aspects of the present disclosure.

In the embodiment illustrated in FIG. 9, the orifice member 24 is visible through the end member 26. Further, FIG. 8 illustrates one or more base member fastener(s) 60 configured to couple the base member 14 to the engine 12. Referring again to FIGS. 2 and 3, the assembly 10 further includes a base member sealing member 50, such as an o-ring in a non-limiting example or a gasket in another non-limiting example, configured to seal the base member 14 and/or the assembly 10 against the engine 12.

The orifice member 24, in one or more embodiments, cooperates with the base member 14 by a means of coupling the orifice member 24 to the base member 14. Such means may include one or more magnetic elements or magnetic portions, one or more threaded or slotted connection structures at an interface between the orifice member 24 and the base member 14, the base member 14 and/or the orifice member 24 being sized and/or configured such that an interference fit is formed between the base member 14 and the orifice member 24, and/or any other structure or elements recognized by one having ordinary skill in the art that is/are capable of coupling the base member 14 to the orifice member 24 without a fastener or other separate element capable of being ingested through the aperture 16 and/or the orifice member 24. In an embodiment, the base member 14, the outer member 18, the air filter 22, and/or the orifice member 24 are configured to prevent objects from flowing into the engine 12 through the aperture 16. As best illustrated in FIGS. 2 and 3, one or more magnets 48 are secured on or within the base member 14 and/or the orifice member 24 with an adhesive, through an interference fit, and/or another secure attachment means.

Figure 5:
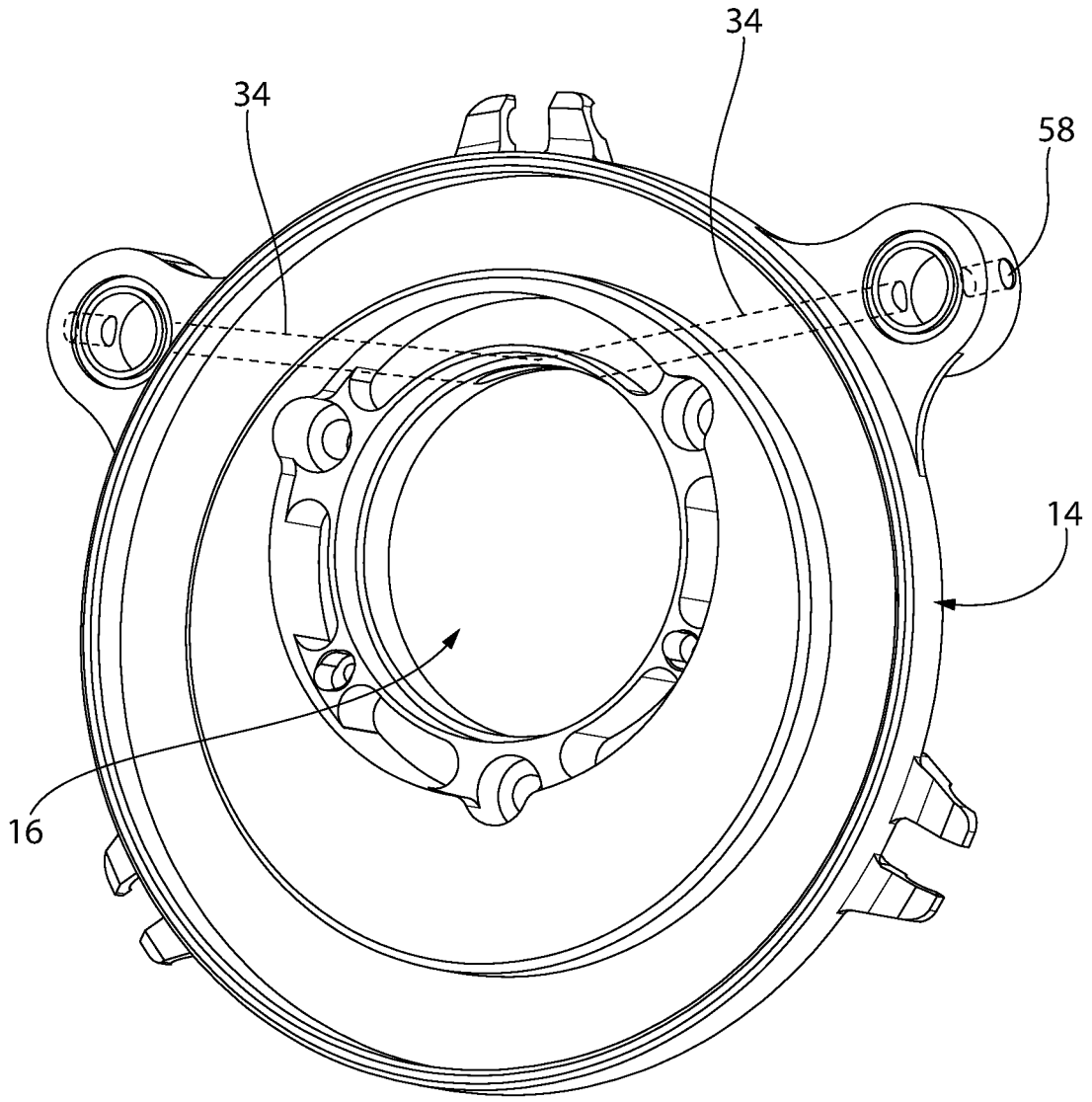
FIG. 5 is a front perspective view of a base member of a vehicle air intake assembly in accordance with aspects of the present disclosure.

As illustrated in FIG. 5, the base member 14 includes at least one base member passage 34 fluidically connected to the aperture 16. Two passages 34 are illustrated in FIG. 5. Although its end point may be visible, the base member passage(s) 34 is/are invisible through the end member 26, as will be apparent from FIG. 9, discussed below.

Figure 6:
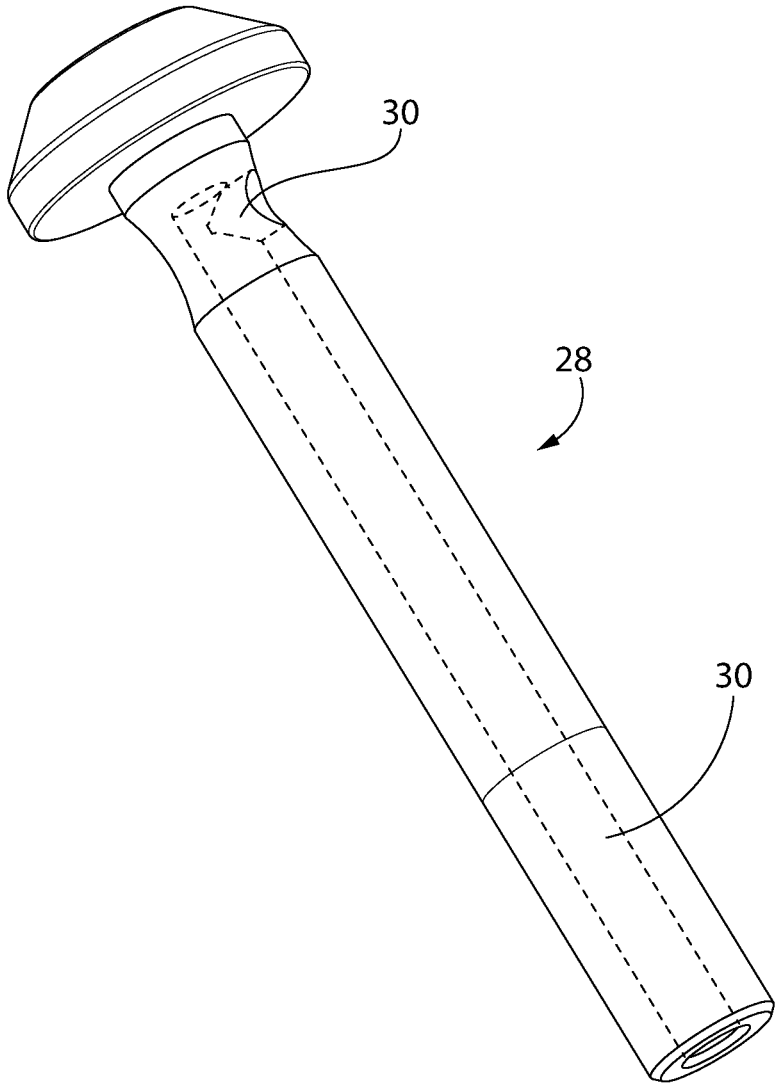
FIG. 6 is a side perspective view of a fastener of a vehicle air intake assembly in accordance with aspects of the present disclosure.

Referring now to FIG. 6 with ongoing reference to FIGS. 2 and 3, the assembly 10 of an embodiment includes at least one fastener 28 configured to couple the base member 14 to the engine 12. Two fasteners 28 are included in the embodiments illustrated in at least FIGS. 2 and 3, but any number of fasteners 28 may be utilized in additional embodiments. One or more fasteners 28 in an embodiment do not fasten but are rather merely breathers for the assembly 10. The fastener 28 includes one or more fastener passage(s) 30 disposed at least partially through the fastener 28 such that at least a portion of air flowing through the aperture 16 further flows through the fastener passage(s) 30. The fastener passage(s) 30 fluidically connects the engine 12 to the base member passage(s) 34 in one or more embodiments.

Figure 7:
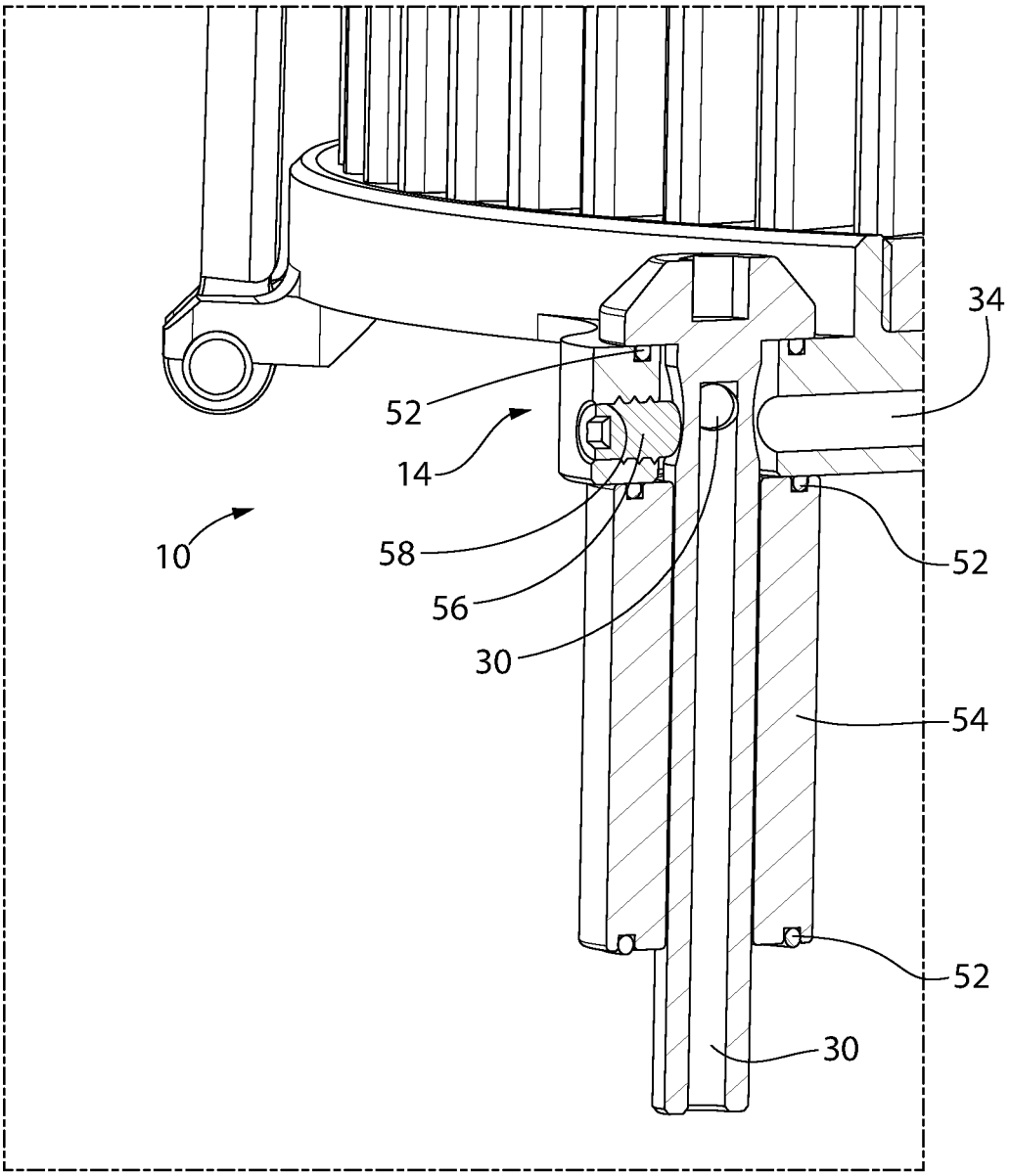
FIG. 7 is an enlarged perspective view of a vehicle air intake assembly in accordance with aspects of the present disclosure.

Referring now to FIG. 7 and as best illustrated in FIGS. 2 and 3, the assembly 10 of one or more embodiments includes one or more fastener sealing member(s) 52 and/or fastener spacer(s) 54 disposed at and/or around the fastener (s) 28. The fastener sealing member(s) 52, such as one or more o-ring(s) in a non-limiting example, are configured to seal the fastener(s) 28, base member 14, and/or the fastener spacer(s) 54. One or more plug(s) 56, such as one or more set screw(s) in a non-limiting example, are configured to restrict airflow through a terminal end 58 of the base member passage(s) 34 such that air flows through the fastener passage(s) 30. In an embodiment, the fastener passage(s) 30 is fluidically connected to a crankcase ventilation system of the engine 12 such that crankcase gases may flow from the engine 12 to the aperture 16 as is understood by a person having ordinary skill in the art.

In an embodiment, the base member 14 is magnetically coupled to the orifice member 24 and/or another orifice member having a different size and/or geometry. As illustrated in FIG. 4, the orifice member 24 includes an orifice passage 32 in an embodiment such that at least a portion of the air flowing through the aperture 16 and the fastener passage 28 further flows through the orifice passage 32.

It will be appreciated that the assembly 10 of one or more embodiments disclosed herein allows intake air to be filtered prior to suction into the engine 12 while minimizing or eliminating the ability for any part or portion of the assembly 10 to be ingested into the engine 12. Additionally, the assembly 10 of one or more embodiments permits the inclusion of different sized and/or configured orifice members 24 based on desired intake air characteristics. The assembly 10 further provides the ability for a user to view one or more internal portions, parts, or spaces in the assembly 10 in order to inspect the assembly 10, an engine intake portion, or another space in an aesthetically pleasing manner. The arms 20 and/or their connection to the base member 14 and/or the outer member 18 allow(s) quick and convenient disassembly of the assembly 10, removal of one or more portion of the assembly 10, and/or replacement or cleaning of the air filter 22, while not impeding the flow of air into and through the air filter 22.

While the disclosure has been illustrated and described in detail in the drawings and foregoing description, the same is to be considered as illustrative and not restrictive in character, it being understood that only certain embodiments have been shown and described and that all changes and modifications that come within the spirit of the disclosure are desired to be protected.

I claim:

1. A vehicle air intake assembly comprising:

a base member having a base member aperture configured to permit a flow of air therethrough;

an outer member spaced from the base member;

an end member disposed radially within the outer member, the end member configured to direct the flow or air between the base member and the outer member and/or restrict the flow of air at the outer member;

an air filter having a first side, a second side, and at least one lateral side, wherein a width of the air filter is defined by a distance between the first side and the second side, the air filter configured to be disposed between the base member and the outer member such that the first side is disposed closer to the base member and the second side is disposed closer to the outer member, and such that the at least one lateral side is exposed and configured to filter the flow of air passing through the at least one lateral side; and a plurality of arms configured to couple the base member to the outer member, each arm of the plurality of arms defined by a distal end non-rotatably coupled to the outer member, and a proximal end rotatably coupled to the base member, wherein a total length of each arm is defined by a distance between the respective distal end and proximal end such that the total length of each arm is greater than the width of the air filter.

2. The vehicle air intake assembly of claim 1, further comprising an orifice member removably coupled to the base member.

3. The vehicle air intake assembly of claim 1, further comprising one of a first orifice member and a second orifice member, the first orifice member having a larger diameter orifice than the second orifice member, wherein the base member is configured to be coupled to the one of the first orifice member and the second orifice member.

4. The vehicle air intake assembly of claim 3, wherein the base member is magnetically coupled to the one of the first orifice member and the second orifice member.

5. The vehicle air intake assembly of claim 1, wherein the end member is at least partially transparent.

6. The vehicle air intake assembly of claim 1, further comprising at least one fastener configured to couple the base member to an engine, wherein the at least one fastener includes a fastener passage defined at least partially within the at least one fastener such that at least a portion of the flow of air flows through the base member aperture and the fastener passage.

7. The vehicle air intake assembly of claim 6, further comprising an orifice member coupled to the base member, wherein the orifice member includes an orifice passage such that the portion of the flow of air that flows through the base member aperture and the fastener passage further flows through the orifice passage.

8. The vehicle air intake assembly of claim 1, wherein one or more magnetic elements or magnetic portions are used to couple an orifice member to the base member.

9. The vehicle air intake assembly of claim 1, wherein one or more threaded or slotted connection structures at an interface between an orifice member and the base member are used to couple the orifice member to the base member.

10. A vehicle air intake assembly comprising:

a base member having a base member aperture configured to permit a flow of air therethrough and into an engine;

an outer member spaced from the base member;

an end member disposed radially within the outer member, the end member configured to direct the flow or air between the base member and the outer member and/or restrict the flow of air at the outer member;

an air filter having a first side, a second side, and at least one lateral side, wherein a width of the air filter is defined by a distance between the first side and the second side, the air filter configured to be disposed between the base member and the outer member such that the first side is disposed closer to the base member and the second side is disposed closer to the outer member, and such that the at least one lateral side is exposed and configured to filter the flow of air passing through the at least one lateral side;

a plurality of arms configured to couple the base member to the outer member, each arm of the plurality of arms defined by a distal end non-rotatably coupled to the outer member, and a proximal end rotatably coupled to the base member, wherein a total length of each arm is defined by a distance between the respective distal end and proximal end such that the total length of each arm is greater than the width of the air filter; and an orifice member removably coupled to the base member at the base member aperture by an orifice member coupling means, such that at least a portion of the orifice member is positioned between the base member and the outer member.

11. The vehicle air intake assembly of claim 10, wherein the outer member, the end member, the air filter, and the orifice member are configured to impede a flow of objects and/or debris into the engine.

12. The vehicle air intake assembly of claim 10, wherein the end member is at least partially transparent.

13. The vehicle air intake assembly of claim 10, wherein the orifice member coupling means comprises one or more magnetic elements or magnetic portions and/or one or more threaded or slotted connection structures at an interface between the orifice member and the base member.

14. A vehicle air intake assembly comprising:

a base member having a base member aperture configured to permit a flow of air therethrough;

an outer member spaced from the base member;

an end member disposed radially within the outer member, the end member configured to direct the flow or air between the base member and the outer member and/or restrict the flow of air at the outer member, the end member further configured to at least partially transmit light such that the base member aperture is visible through the end member;

an air filter having a first side, a second side, and at least one lateral side, wherein a width of the air filter is defined by a distance between the first side and the second side, the air filter configured to be disposed between the base member and the outer member such that the first side is disposed closer to the base member and the second side is disposed closer to the outer member, and such that the at least one lateral side is exposed and configured to filter the flow of air passing through the at least one lateral side;

a plurality of arms configured to couple the base member to the outer member, each arm of the plurality of arms defined by a distal end non-rotatably coupled to the outer member, and a proximal end rotatably coupled to the base member, wherein a total length of each arm is defined by a distance between the respective distal end and proximal end such that the total length of each arm is greater than the width of the air filter, and such that the plurality of arms encompass the air filter between the base member and the outer member; and an orifice member removably coupled to the base member at the base member aperture by an orifice member coupling means, such that at least a portion of the orifice member is positioned between the base member and the outer member.

15. The vehicle air intake assembly of claim 14, wherein the base member includes at least one base member passage fluidically connected to the base member aperture.

16. The vehicle air intake assembly of claim 15, wherein the orifice member includes an orifice member passage fluidically connecting the at least one base member passage to the base member aperture, the orifice member passage being visible through the end member.

17. The vehicle air intake assembly of claim 16, further comprising at least one fastener configured to couple the base member to an engine, wherein the at least one fastener includes a fastener passage defined therein, such that the fastener passage fluidically connects the engine to the at least one base member passage.

18. The vehicle air intake assembly of claim 14, wherein the orifice member is defined by one of a first orifice member and a second orifice member, the first orifice member having a larger diameter orifice than the second orifice member, and such that the first orifice member is interchangeable with the second orifice member.

* * * * *